United States Patent [19]

Kommm

[11] 4,436,504

[45] Mar. 13, 1984

[54] APPARATUS FOR MONITORING EXHAUST GASES

[76] Inventor: Rolf Kommm, Schulstrasse 43/1, D 7300 Esslingen 1 - Berkheim, Fed. Rep. of Germany

[21] Appl. No.: 360,237

[22] Filed: Mar. 22, 1982

[30] Foreign Application Priority Data

Apr. 30, 1981 [DE] Fed. Rep. of Germany ..... 3117158

[51] Int. Cl.[3] ..... F23N 5/24

[52] U.S. Cl. ..... 431/15; 431/80; 136/230

[58] Field of Search ..... 431/13, 15, 76–80, 431/189; 236/15 E, 94; 136/230, 242; 307/117; 340/584, 632

[56] References Cited

U.S. PATENT DOCUMENTS

| | | | |
|---|---|---|---|
| 2,304,489 | 12/1942 | Wetzel | 431/80 |
| 2,326,217 | 8/1943 | Hart | 136/230 |
| 2,705,746 | 4/1955 | Strange | 136/230 |
| 3,307,608 | 3/1967 | Cowan | 431/15 |
| 4,296,727 | 10/1981 | Bryan | 431/76 |

FOREIGN PATENT DOCUMENTS

| | | | |
|---|---|---|---|
| 2049544 | 11/1971 | Fed. Rep. of Germany . | |
| 7210667 | 12/1974 | Fed. Rep. of Germany . | |
| 8004599 | 2/1980 | Fed. Rep. of Germany . | |
| 8017120 | 8/1980 | Fed. Rep. of Germany . | |
| 233253 | 4/1969 | U.S.S.R. | 136/230 |

*Primary Examiner*—Lee E. Barrett
*Attorney, Agent, or Firm*—Edward E. Sachs

[57] ABSTRACT

Exhaust gases produced by combustion of fuel are monitored by a sensing probe. An indicating device responsive to signals from the sensing probe provides a readout of a condition sensed by the probe. At least one signaling device responsive to signals from the sensing probe provides a warning signal when the sensed condition is a predetermined value. An interrupting device responsive to signals from the sensing probe interrupts the combustion of fuel when the sensed condition is above the predetermined value.

6 Claims, 4 Drawing Figures

Fig. 1
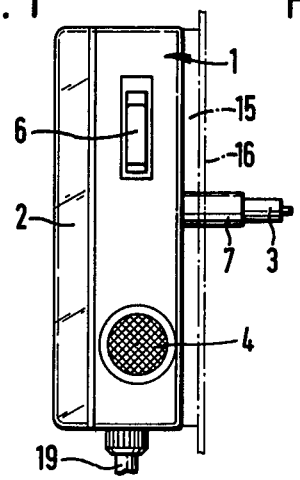
Fig. 2
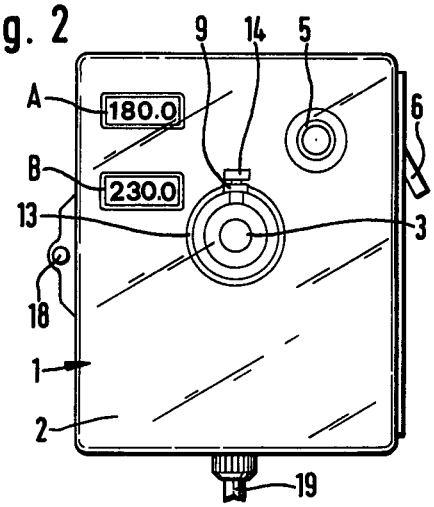
Fig. 3
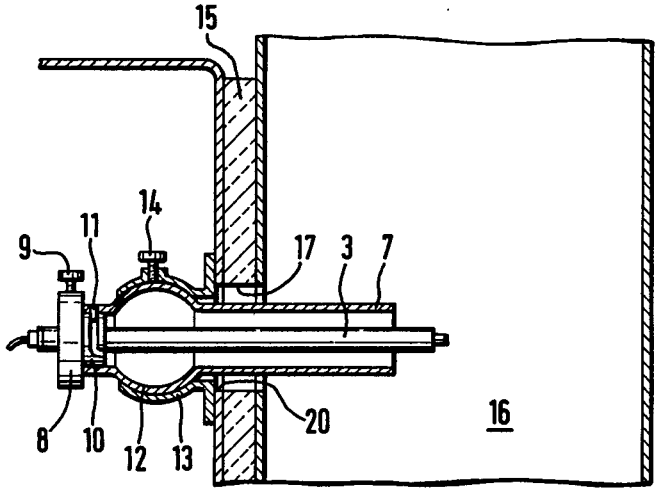
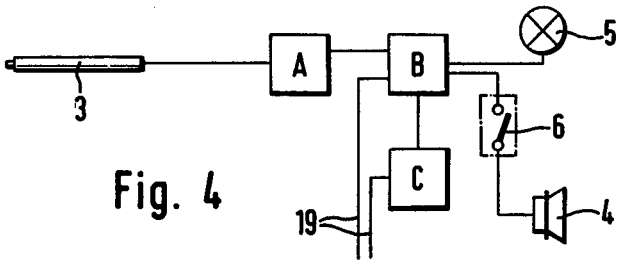
Fig. 4

APPARATUS FOR MONITORING EXHAUST GASES

BACKGROUND OF THE INVENTION

This application relates to the art of monitoring instruments or the like and, more particularly, to apparatus for monitoring the condition of exhaust gases flowing through an exhaust conduit. The apparatus of the present application is particularly applicable for use in monitoring the temperature of exhaust gases from combustion of fuel and will be described with specific reference thereto. However, it will be appreciated that the apparatus of the present application can be used for other purposes and for monitoring other conditions than temperature.

During combustion of fuel in such facilities as heating plants or the like, certain conditions of the exhaust gases are measured by skilled persons at periodic intervals. Adjustments are made in accordance with the measured conditions. The intervals between measuring certain conditions of the exhaust gases are sometimes quite long and this makes it possible for the plant to operate in an inefficient or environmentally harmful manner. It would be desirable to have an automatic monitoring system for automatically and continuously monitoring the condition of the exhaust system and the gases therein.

SUMMARY OF THE INVENTION

The temperature of exhaust gases from combustion of fuel is continuously monitored by sensing means. Indicating means responsive to signals from the sensing means provides a continuous readout of the temperature of the exhaust gases. Signaling means responsive to signals from the sensing means provides a warning signal when the sensed temperature is a predetermined value. Interrupting means responsive to signals from the sensing means interrupts the combustion of fuel when the sensed temperature is above the predetermined value.

In a preferred arrangement, a common housing is provided for all of the sensing means, indicating means, signaling means and interrupting means.

The signaling means may take the form of separate audible and visual signal devices. Disconnecting means accessible externally of the housing is provided for disconnecting the audible signaling means. Disconnecting means for disconnecting the visual signal device is accessible only by opening the housing.

The sensing means is in the form of an elongated probe which is mounted to the housing for providing selective longitudinal and generally swiveling movement of the probe. In one arrangement, the housing includes a rear wall having a hole therethrough. A generally spherical-type of socket is attached to the housing around the hole. A sleeve extending through the hole has a generally spherical-type of protuberance thereon closely received in the socket for generally swiveling movement. The probe extends through the sleeve and is longitudinally movable relative thereto. First clamping means is provided for releasably clamping the sleeve against movement relative to the socket, and second clamping means is provided for clamping the probe against movement relative to the sleeve.

With the apparatus of the present application, a continuous visual readout is provided for the temperature of the exhaust gases. The signaling means may be set to be tripped when the temperature is up to around 25° higher than the desired temperature of the exhaust gases. Once the signaling means is tripped, it will warn the plant operators that adjustments are required. In the event the signaling means fails to operate or otherwise fails to warn the plant operators, the interrupting means may be set at a still higher temperature setting so that it is tripped to shut down the plant as by discontinuing the flow of fuel to the combustion chamber.

It is a principal object of the present invention to provide an apparatus which is reliable and easy to maintain for monitoring the condition of exhaust gases from combustion of fuel.

It is another object of the invention to provide such an apparatus which automatically provides a warning signal and, if necessary, automatically interrupts the combustion of fuel.

It is an additional object of the invention to provide such an apparatus which is self-contained in one housing.

BRIEF DESCRIPTION OF THE DRAWING

FIG. 1 is a side elevational view of an apparatus constructed in accordance with the present application;

FIG. 2 is a front elevational view thereof;

FIG. 3 is a partial cross-sectional side elevational view showing a sensing probe inserted in an exhaust gas conduit; and FIG. 4 is a schematic wiring diagram.

DESCRIPTION OF A PREFERRED EMBODIMENT

With reference to the drawing, FIGS. 1 and 2 show a generally rectangular housing 1 having a cover 2 connected hingedly or otherwise thereto so that it can be opened to provide access to the interior thereof. The cover 2 is locked in its closed position as by a lead seal 18 in FIG. 2 or by other locking means which prevents unauthorized access to the interior of the housing. Sensing means 3 for sensing a condition of the exhaust gases is shown in the form of an elongated sensing probe for sensing the temperature of the exhaust gases. The sensing probe 3 may be of any suitable type, including a thermocouple, resistance element or a temperature gauge transformer. Signals from the sensing means 3 are proportional to the temperature of the exhaust gases and are received by relays A, B and C. The relay A provides a continuous digital readout as shown in FIG. 2 of the exhaust gas temperature. The entire cover 2 may be transparent or a small window may be provided for the digital temperature readout. The relay B is manually set to a predetermined value of temperature for operating signaling means to provide a warning signal when that predetermined value of temperature is sensed. By way of example, the relay B may be set to a temperature up to around 25° higher than the desired normal temperature of the exhaust gases when the combustion of fuel is taking place in an efficient and environmentally satisfactory manner. The signaling means operated by the relay B may be in the form of an audible signal device 4 and a visual signal device 5. The audible signal device 4 may be a bell, buzzer or horn, while the visual signal device 5 may be a bright light which will remain on continuously or will flash on and off. A switch 6 may be interposed between the relay B and the audible signal device 4. The switch 6 has an operating handle accessible externally of the housing 1 for disconnecting the audible signal device 4 until adjustments or repairs can be made.

It will be recognized that the apparatus is connected to a suitable voltage source as by a cable 19 extending through a bottom wall of the housing 1. The various relays and the like are operated by current from the separate voltage source and the signals from the sensing means simply connect the various indicating, signaling and interrupting means to the separate voltage source. The relays A, B and C may be of any conventional type, including microprocessors for relaying signals from the sensing means to operate the other devices.

The sensing probe 3 is preferably mounted by a mounting means for providing generally swiveling movement and longitudinal movement of the sensing probe. FIG. 2 shows an exhaust conduit 16 for exhaust gases from a combustion chamber. The housing 1 is suitably attached to the conduit 16 with an insulating plate 15 interposed therebetween. A hole 20 in the rear wall of the housing 1 is aligned with a hole 17 through the insulating plate and the conduit 16. A generally spherical-type of socket member 13 is secured within the housing 1 to the rear wall thereof around the hole 20. An elongated sleeve 7 extends through the holes 17,20 and has a generally spherical-type of protuberance 12 thereon closely received in the socket member 13 for providing generally swiveling movement of the sleeve 7. Clamping means for releasably clamping the sleeve 7 against movement relative to the socket member 13 may take the form of a screw 14 threaded through a tapped hole in the socket member 13 for engaging the protuberance 12.

A ring member 8 has a central hole therethrough of a size for closely receiving the sensing probe 3. The ring member includes a cylindrical portion 10 closely receivable within the rear end of the sleeve 7 within the housing 1. The cylindrical portion 10 has a circumferential groove therein communicating with a short axial groove. An inwardly extending projection on the rear end portion of the sleeve 7 is receivable through the axial groove, and the ring member 8 is then rotated for moving the projection into the circumferential groove 11 for releasably locking the ring member 8 to the sleeve 7. The sensing probe 3 is longitudinally movable relative to the ring member 8 for adjusting the position of the end of the sensing probe within the conduit 16. The sensing probe 3 is locked in position against longitudinal movement relative to the ring member 8 by clamping means in the form of a screw 9 threaded into a suitable tapped hole in the ring member 8.

Manual disconnect means 6 is accessible externally of the housing 1 for turning off the audible signal device 4. Another similar disconnect means, such as a switch, for the visual signal device 5, is located within the housing 1 and is accessible only by opening the cover 2. The interrupting means generally indicated by the relay C may operate another switch or valve for completely shutting down the flow of fuel to the combustion chamber or otherwise shutting down the plant.

In using the apparatus, the housing is mounted to the conduit 16, and the clamping screws 9,14 are loosened for properly locating the sensing probe 3 within the conduit 16. The clamping screws 9,14 are then tightened and may be suitably leaded for preventing unauthorized tampering with the position of the sensing probe. The relay B is then set to a desired predetermined value of temperature, such as up to around 25° higher than the normal desired temperature of the exhaust gases when combustion is taking place in an efficient and environmentally satisfactory manner. The relay C is also positioned within the housing 1 and is manually set to a temperature value which is slightly greater than the predetermined value set on the relay B. The housing cover 2 is then closed and provided with the lead seal 18 or other type of locking means for preventing unauthorized access to the interior of the housing. As the exhaust gases flow through the conduit 16, a digital readout of the temperature is provided continuously by the relay A. In the event a malfunction occurs and the combustion of fuel is not taking place efficiently, the temperature of the exhaust gases will rise to the predetermined value set on the relay B. At that time, the signaling means defined by the signal devices 4,5 will be operated. It is possible for an operator to trip a lever for opening the switch 6 to stop the audible signal device 4 while the necessary adjustments are made. However, turning off the visual signal device 5 requires opening of the cover 2. In the event the temperature rises above the predetermined value set by the relay B, the relay C will be tripped and will shut down the plant as by discontinuing the flow of fuel to the combustion chamber.

Different types of probes, such as those for measuring oxygen or carbon dioxide, may be introduced into the conduit 16. This is very easy to do because the ring member 8 along with the sensing probe 3 can be removed from the sleeve 7 simply by rotating the ring member 8 until the inwardly extending projection on the sleeve 7 is aligned with the axial groove in the cylindrical portion 10 of the ring member. The ring member 8 can then be axially withdrawn from the sleeve 7. An oxygen or carbon dioxide measuring probe can then be inserted through the sleeve 7. Afterwards, the sensing probe 3 is immediately returnable to its original position simply by extending same through the sleeve 7 and placing the ring member 8 back in its locked position on the sleeve 7.

It will be recognized that the signal devices 4,5, or additional signal devices, may be located externally of the housing 1 and remote therefrom if so desired. The improved apparatus of the present application provides a continuous readout of the exhaust gas temperature and responds immediately when the temperature rises to a predetermined value representative of inefficient or environmentally harmful operation. The special construction of the housing insures that only authorized persons can make adjustments.

While there has been described what is at present considered to be the preferred embodiment of this invention, it will be obvious to those skilled in the art that various changes and modifications may be made therein without departing from the invention, and it is aimed, therefore, in the appended claims to cover all such changes and modifications as fall within the true spirit and scope of the invention.

What is claimed is:

1. Apparatus for monitoring exhaust gases from the combustion of fuel, particularly a heating system, comprising in combination:

a housing having an opening communicating with the exhaust gases;

an elongated and interchangeable sensing probe in the housing extending through the opening;

probe mounting means within the housing to mount said probe selectively for swivel and longitudinal movement and locking position;

temperature indicating means responsive to signals from said probe for indicating the sensed condition;

signaling means responsive to signals from the probe for providing an audible and/or visual warning signal when the sensed condition reaches a first predetermined value;

interrupting means responsive to signals from the probe for automatically interrupting the combustion of fuel when the sensed condition has reached a second predetermined value which exceeds said first value; and an electric circuit including a voltage source and a plurality of relays for relaying signals from said probe to the indicating, signaling and interrupting means.

2. The apparatus of claim 1, wherein said probe is removably arranged by said mounting means to enable manual interchange of probes.

3. The apparatus of claim 1 wherein said housing includes a rear wall having said opening therethrough, said probe mounting means including a generally spherical-type of socket attached to said housing around said opening, a sleeve extending through said opening and having a generally spherical-type of protuberance thereon closely received in said socket for generally swiveling movement, said probe extending through said sleeve and being longitudinally movable relative thereto, first clamping means for releasably clamping said sleeve against movement relative to said socket, and second clamping means for clamping said probe against movement relative to said sleeve.

4. The apparatus of claim 1 wherein said signaling means includes disconnect means accessible externally of said housing for disconnecting said signaling means.

5. The apparatus of claim 1 wherein said signaling means includes both audible and visual signal devices.

6. The apparatus of claim 5 including audible disconnect means accessible externally of said housing for disconnecting said audible signal device, said housing including a selectively openable cover, and visual disconnect means internally of said housing accessible by opening said cover for disconnecting said visual signal device.

* * * * *